United States Patent [19]

Horlacher

[11] Patent Number: 4,615,082

[45] Date of Patent: Oct. 7, 1986

[54] SLIDER FOR A SLIDE FASTENER

[76] Inventor: Hans Horlacher, Weinbergstrasse 41, 8134 Adliswil, Switzerland

[21] Appl. No.: 745,207

[22] Filed: Jun. 17, 1985

[30] Foreign Application Priority Data

Jun. 21, 1984 [CH] Switzerland ..... 3011/84

[51] Int. Cl.[4] ..... A44B 19/30

[52] U.S. Cl. ..... 24/418; 24/419; 24/420; 24/427

[58] Field of Search ..... 24/418, 419, 420, 427, 24/428

[56] References Cited

U.S. PATENT DOCUMENTS

| | | | |
|---|---|---|---|
| 2,174,002 | 9/1939 | Hyde | 24/418 |
| 2,867,881 | 1/1959 | Morin | 24/419 |
| 2,900,695 | 8/1959 | Morin | 24/418 |
| 3,597,810 | 8/1971 | Llotte | 24/419 |
| 4,161,053 | 7/1979 | Ruhrmann | 24/420 |
| 4,438,550 | 3/1984 | Oda | 24/418 |

FOREIGN PATENT DOCUMENTS

| | | | |
|---|---|---|---|
| 768354 | 10/1967 | Canada | 24/418 |
| 215929 | 11/1941 | Switzerland | 24/419 |
| 297818 | 6/1954 | Switzerland | 24/418 |
| 598780 | 5/1978 | Switzerland . | |

*Primary Examiner*—Victor N. Sakran
*Attorney, Agent, or Firm*—Laubscher & Laubscher

[57] ABSTRACT

The slider of the slide fastener comprises a slider body, a locking member which is held on the one hand by a locking portion on the slider body and on the other hand is provided with teeth. A slot provided in the locking portion forms a joint section allowing a pivoting of the locking member and a moving of the teeth into a disengagement with the slide fastener.

The teeth comprise a viewed in closing direction rear inclined flank, by means of which a brake action is generated in place of a locking action if the already separated slide fastener strips are pulled laterally away from each other such that the slide fastener can be opened even in case of a missing drawing flap.

7 Claims, 3 Drawing Figures

SLIDER FOR A SLIDE FASTENER

BACKGROUND OF THE INVENTION

1. Field of the Invention

The present invention relates to a slider for a slide fastener, which slider includes a slider body, a locking member having on the one hand at least one tooth intended to engage in its rest position between adjacent coupling members of a slide fastener and having on the other hand a locking portion which is inserted in the slider body, which tooth is integrally formed at one end and which locking portion is integrally formed at the other end of a web section, and includes a drawing flap which projects under a center area of the web section in order to lift the tooth out of the engaging position.

2. Description of the Prior Art

The Swiss patent specification CH-PS No. 598 780 discloses a slider for a slide fastener comprising a bipartite slider body, a locking member mounted on the slider body and a drawing flap which operates the locking member. The locking member is provided on the one hand with a tooth which in its rest position can engage between adjacent coupling members of a slide fastener and on the other hand a pin which is fixedly mounted in the slider body. The tooth is formed at one end and the pin at the other end of an elastically yielding web. As mentioned above, the locking member is operated by the drawing flap, whereby the pulling force acting thereupon causes a pivoting of the elastic web together with the tooth. By means of the pin formed at this elastically yielding web, the web is bent upon a pivoting movement, which bending occurs at a section of the web located adjacent of the pin.

This slider incorporates a plurality of drawbacks. On the one hand the molding form necessary for producing the locking member is rather a complicated design due to the mentioned pin formed at the web and due to the hole in the slider body for receiving the pin and the assembling of the locking member at the slider body is rather intrinsic. Furthermore, the web has no clearly defined pivoting or bending, respectively, section such that the locking member must be lifted by the pivoting of the drawing flap.

SUMMARY OF THE INVENTION

Hence, it is an object of this invention to provide a slider for a slide fastener which does not incorporate the above mentioned drawbacks.

A further object is to provide a slider for a slide fastener designed such that the drawing flap can be inserted together with the locking member without specific measures and that the locking member includes a pivoting or bending area which is defined by a joint-like section.

A further object is to provide a slider for a slide fastener, in which its slider body comprises an upper portion and a lower portion integrally interconnected by a web section extending therebetween and forming a Y-shaped passage channel for the slide fastener defined by flanges formed at either side of the upper portion. The slider body also comprises at least one recess located above the passage channel and at the front face when viewed in the closing direction, which recess is intended to receive the locking portion if inserted therein. The locking portion comprises at least one slot for forming a section acting as a joint and is inserted into the slider body that the slot extends parallel to the passage channel allowing a pivoting movement of the locking member around an axis extending parallel to the passage channel.

Preferably, the slot extending parallel to the passage channel is open when viewed in the closing direction.

According to a preferred embodiment of the invention the tooth comprises an inclined—when viewed in the closing direction—rear flank. Due to such design a braking action is arrived at instead of a blocking of the slider of the slide fastener, which blocking can lead, upon a pulling at the already separated slide fastener coupling member carrying webs, to a destruction of the slide fastener, for instance, by tearing individual coupling members off of the locking members' supporting web. The aforementioned braking action prevents damage and destruction of the slide fastener and, furthermore, the slide fastener can also be opened in case the drawing flap is missing.

BRIEF DESCRIPTION OF THE DRAWINGS

The present invention will be more fully understood by reference to the following detailed description thereof when read in conjunction with the attached drawings, and wherein.

DESCRIPTION OF THE PREFERRED EMBODIMENT

Figure 1:
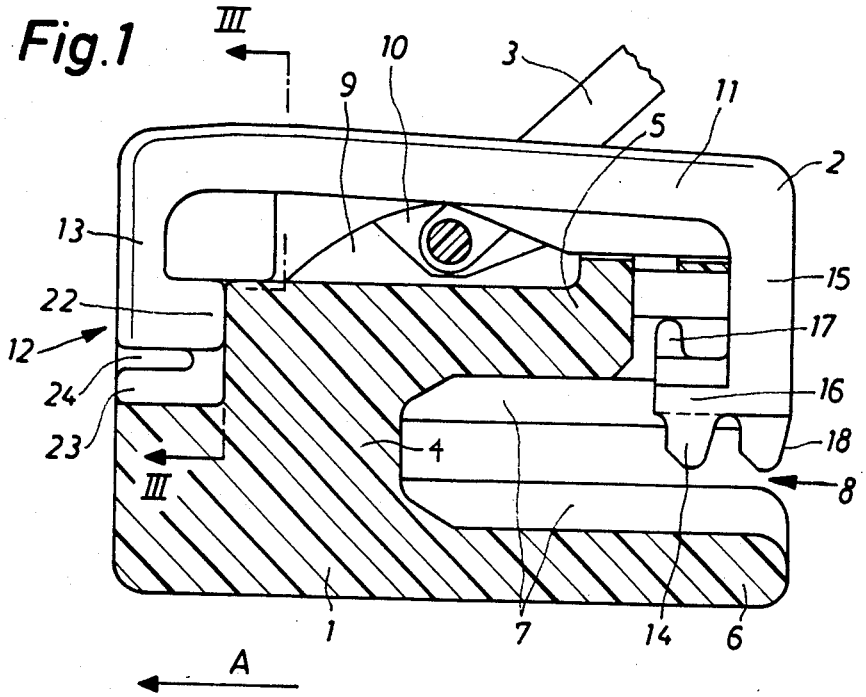
FIG. 1 illustrates a view of a section of an embodiment of the slider for a slide fastener constructed in accordance with the present invention.

According to the illustration of FIG. 1 the slider for a slide fastener is made of three parts and comprises a slider body 1, a locking member 2 and a drawing flap 3, all of which are made of a synthetic plastic material. The slider body 1 consists of an upper portion 5 and a lower portion 6, which two portions are integrally connected to each other by means of a web section 4, which slider body 1 includes a Y-shaped passage channel 8 for the slide fastener defined by flanges 7 formed at both sides of the upper and lower portion 5, 6. The web section 4 forms the so-called separating wedge.

Two projections 9 are formed at the upper side of the slider body 1, which projections 9 include each a notch 10 defined by two inclined surfaces. Both projections 9 and accordingly the notches 10 are covered by the locking member 2 in the assembled condition. Accordingly, the notches 9 and the locking member 2 form a passage for the web of the drawing flap 3.

The locking member 2 comprises a web 11, which is reinforced by ribs and thus is relatively rigid, and includes a locking portion 12, which when viewed in the closing direction (arrow A) is formed at the forward end of a leg 13 projecting roughly perpendicularly from web 11 and reaching over the projections 9 and has further two teeth 14 which—when viewed in direction of closing—are located at the rearward end of a leg 15 projecting perpendicularly from web 11 and extending over the projections 9. A flange 16 which projects inwards is formed at the end of the leg 15. The teeth 14 project from the flange 16 in a direction away from the web 11 and a ledge 17 projects from the flange 16 in a direction towards the web 11. The teeth 14 comprise a—when viewed in direction of closing—rear inclined flank 18.

Figure 2:
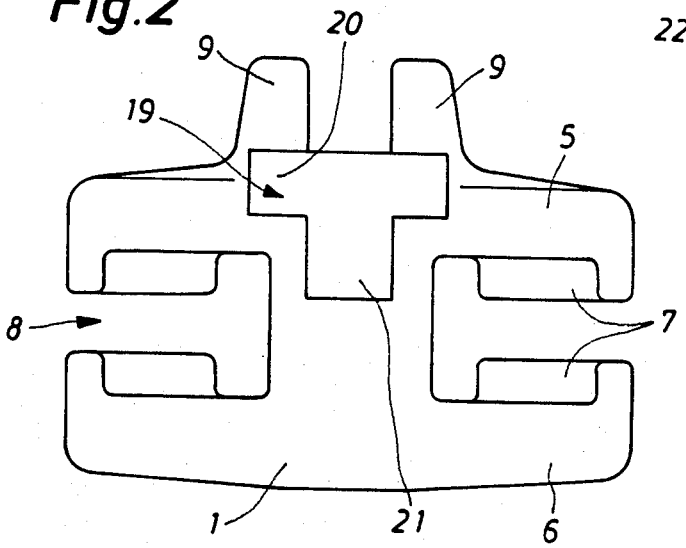
FIG. 2 illustrates a view of the front face of the slider body viewed in the closing direction.

Such as best illustrated in FIG. 2, the front face of the slider body 1, when viewed in direction of closing, comprises a T-shaped recess 19 including a first recess section 20 extending parallel to the passage channel 8 and a second recess section 21 extending perpendicularly to the passage channel 8 whereby the locking portion 12 is insertable into mentioned recess 19. To this end the locking portion 12 comprises a first section 22 which is located within the first recess 20 of the slider body 1 and a second section 23 which is located within the second recess 21 of the slider body 1.

Figure 3:
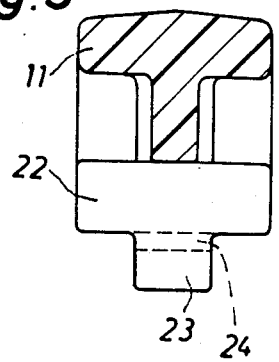
FIG. 3 illustrates a view of a section taken along line III—III of FIG. 1, whereby the slider body is omitted.

According to FIG. 3 the first section 22 extends roughly parallel to the web 11 and the second section 23 extends perpendicularly to the web 11 and projects away from the first section 22. Accordingly, the locking portion 12 is shaped complementary to the T-shaped recess 19. The second section 23 is provided with a slot 24, which is open at its forward end viewed in the closing direction (FIG. 1).

When the slide fastener is to be opened, the slider is moved in the direction opposite to the direction indicated by means of the arrow A by pulling or drawing, respectively, the drawing flap 3. Such as can be seen clearly in FIG. 1, such pulling causes the web of the drawing flap 3 to be moved into the notch 10 against the web 11 of the locking member and the web 11 is pivoted in the direction facing away from the slider body 1 because the locking member 2 is held by means of the locking portion 12 at one side on the slider body 1. Because the locking member 2 notwithstanding the elasticity of the material from which it is made is designed as a rigid body and to this end is provided with ribs, the pivoting of the web proceeds in the general area of the slot 24 located in the second section 23 of the locking portion 12, i.e. the section remaining in the area of the slot acts as a joint.

Due to this design of the locking portion 12, a locking is achieved by the first section 22 which corresponds to the pulling force acting onto the drawing flap 3 and a clearly defined pivoting area is provided by the second section 23.

If the two slide fastener bands (carrying the plurality of the slide fastener coupling members) are manually pulled away from each other, a force will act onto the slider of the slide fastener, which strives to move the slider in direction of opening. However, the slider of the slide fastener is supported via the teeth 14 on the flanks 18 of the teeth 14 and such is locked against movement. If now, this pulling force is increased, the force acting onto the slider and onto the flanks 18 of the teeth 14 is great enough to pivot the drawing flap 3 and urge the teeth 14 out of engagement.

Because the flank 18 is inclined relative to the vertical to the passage channel 8, the pulling force can be limited such that the slide fastener is not damaged or destroyed and, furthermore, that the slide fastener can be opened even when the drawing flap is missing.

While there is shown and described a present preferred embodiment of the invention, it is to be distinctly understood that the invention is not limited thereto, but may be otherwise variously embodied and practiced within the scope of the following claims.

I claim:

1. A slider for a slide fastener, comprising (a) a slider body member, including (1) upper and lower portions integrally interconnected by a web section extending therebetween; and (2) flange portions formed at either side of said body upper portion to define a Y-shaped passage channel adapted to receive the slide fastener, said body member further containing at least one recess arranged above said passage channel in the front portion of said body member relative to the closing direction of sliding movement thereof, said recess having a T-shaped configuration and including a first recess section extending parallel to said passage channel and a second recess section extending perpendicular to said passage channel;

(b) a locking member including at one end at least one tooth portion and at the other end a locking portion, said tooth and locking portions being integrally connected by a web section therebetween, said tooth portion being adapted for engagement between adjacent locking members of a slide fastener when in a rest position, said locking portion including a first section arranged within said first recess section and a second section arranged within said second recess section for connecting said locking member with said body member, said locking portion second section containing a slot beneath said locking portion first section and parallel to said body member passage channel to define a joint affording pivotal movement of said locking member about an axis extending parallel to said passage channel; and (c) a drawing flap connected with said body member and projected under a central portion of said locking member web section for lifting said locking member tooth portion out of engagement between adjacent locking members.

2. A slider for a slide fastener, comprising (a) a slider body member, including (1) upper and lower portions integrally interconnected by a web section extending therebetween; and (2) flange portions formed at either side of said body upper portion to define a Y-shaped passage channel adapted to receive the slide fastener, said body member further containing at least one recess arranged above said passage channel in the front portion of said body member relative to the closing direction of sliding movement thereof;

(b) a locking member including at one end at least one tooth portion and at the other end a locking portion, said tooth and locking portions being integrally connected by a web section therebetween, said tooth portion being adapted for engagement between adjacent locking members of a slide fastener when in a rest position, said locking portion being arranged within said body member recess for connecting said locking member with said body member, said locking portion containing a slot extending parallel to said body member passage channel to define a joint affording pivotal movement of said locking member about an axis extending parallel to said passage channel; and (c) a drawing flap connected with said body member and projected under a central portion of said locking member web section for lifting said locking member tooth portion out of engagement between adjacent locking members.

3. Apparatus as defined in claim 2, wherein said recess and said locking portion have a circular cross-sectional area.

4. Apparatus as defined in claim 2, wherein said recess and said locking portion have a rectangular cross-sectional area.

5. Apparatus as defined in claim 2, wherein said slot is open in the closing direction of sliding movement of said body member.

6. Apparatus as defined in claim 2, wherein said tooth portion comprises a flank inclined in the closing direction of sliding movement of said body member.

7. Apparatus as defined in claim 2, wherein said locking member includes two tooth portions.

* * * * *